US006454265B1

(12) United States Patent
Elliott et al.

(10) Patent No.: US 6,454,265 B1
(45) Date of Patent: Sep. 24, 2002

(54) GAME USING CARDS AND TOKENS

(76) Inventors: Megan L. Elliott, 10324 Autunm Sage, NW., Albuquerque, NM (US) 87114; Kathryn L. Elliott, 10324 Autunm Sage, NW., Albuquerque, NM (US) 87114; Bridget L. Elliott, 10324 Autunm Sage, NW., Albuquerque, NM (US) 87114; Russell D. Elliott, 10324 Autunm Sage, NW., Albuquerque, NM (US) 87114

( * ) Notice: Subject to any disclaimer, the term of this patent is extended or adjusted under 35 U.S.C. 154(b) by 0 days.

(21) Appl. No.: 09/528,358

(22) Filed: Mar. 17, 2000

(51) Int. Cl.[7] ..... A63F 1/00
(52) U.S. Cl. ..... 273/292
(58) Field of Search ..... 273/292, 297, 273/302–308

(56) References Cited

U.S. PATENT DOCUMENTS 2,072,799 A * 3/1937 Creswell ..... 273/308
5,816,576 A * 10/1998 Aramapakul et al. ..... 273/292
6,017,034 A * 1/2000 Hennessey ..... 273/296
6,142,475 A * 11/2000 Hennessey ..... 273/292
6,196,547 B1 * 3/2001 Pascal et al. ..... 273/139
6,247,697 B1 * 6/2001 Jewett ..... 273/292
6,302,397 B1 * 10/2001 Al-Shanfa ..... 273/257
6,332,615 B1 * 12/2001 Watanabe ..... 273/298

OTHER PUBLICATIONS

Scarne's Encyclopedia of Games, By John Scarne, Harper & Row Publishers, 1973 pp. 33–83.*

* cited by examiner

*Primary Examiner*—Jessica Harrison
*Assistant Examiner*—Alex F. R. P. Rada, II

(57) ABSTRACT

A game using cards (or other similar elements) in which multiple players engage in play generally involving taking turns with the objective of gaining tokens or other elements representative of point. According to the invention, each turn may include taking actions assocaited with cards in their hands, drawing cards from a deck, discarding cards, and exchanging cards with other players. According to one embodiment of the game, the step of exchanging cards occurs at the end of a player's turn. The game offers flexibility and ease of adaptation since its stucture of play accommodates use of game pieces and other game elements that can be readily customized and tailored to suit consumer interests.

17 Claims, No Drawings

GAME USING CARDS AND TOKENS

BACKGROUND OF THE INVENTION

1. Field of the Invention

The invention relates generally to the field of amusement games played using cards or other similar elements according to a set of pre-established game rules. More specifically, the invention relates to a game in which multiple players engage in play generally involving taking turns, wherein each turn may include taking actions associated with cards in their hands, drawing cards from a deck, discarding cards, and exchanging cards with other players, with the objective being accumulating points or tokens representative of points, according to pre-established rules of the game. The game offers flexibility and ease of adaptation since its structure of play accommodates use of game pieces and other game elements that can be by customized and tailored to suit consumer interests.

2. Background of the Related Art

Drawing games

Various types of card games are well-known and popular wherein players are dealt hands comprising generally a plurality of cards which either afford their holders advantages, or saddle them with disadvantages, relative to accomplishing the goals of the game. One example is the game known as "Old Maid". In that game (and variations thereon) the object of the game is to arrive at the end of the game without holding a card designated the "old maid." In at least one variation of that game, all of the cards in a deck are distributed (dealt) to the players so that each player has a "hand" of cards. Then, the players in turn exchange cards with one another by "drawing" from each others' hands. Depending on which cards are acquired a player may be required (or allowed) to "discard" certain cards or combinations of cards (for instance, pairs) with the result that the number of cards in his or her hand will be depleted. Ultimately, players will "go out" as all of their cards are discarded in pairs or drawn by other players. Suspense in the game of "Old Maid" results from the players not knowing when or if they may draw the "old maid" card from an opponent.

Another example of a card game in which players exchange cards with one another is the game known as "Go Fish". In that game (or at least one variation thereon), players are dealt hands comprising a predetermined number of cards (for instance, seven). A turn of play comprises a player asking an opponent whether he or she is holding a certain kind of card in his or her hand. The asking player does so in hopes of collecting matching cards and generating, for instance, pairs or four of a kind which the asking player then discards (or otherwise sets aside). In that game, if one player requests a type of card the opponent does not have, the opponent responds by directing the requesting player to "go fish" whereupon the requesting player draws a card from a deck or pile of cards. In this way, drawing from the deck or pile of cards affords the requester a second chance to collect the requested card. The game ends when one or more players "go out" by discarding all of their cards. Winners are determined, for example, according to which player goes out first, or alternatively, according to who had discarded or set aside the most pairs or groups of four-of-a-kind at the time when a player goes out.

Each of the games just described share a similarity in the sequence of play in that the exchange of cards between players occurs early in the course of a turn of play and, at least potentially, as a predicate to other events taking place during a turn of play. In this way, subsequent activity during that specific turn of play may either aggravate or alleviate the consequences of the exchange of cards for a given player. In "Old Maid", following the transfer of a card from one player to another, the recipient player may have an option to discard a newly generated pair, for example, and enhance that player's competitive standing by bringing that player closer to "going out". In "Go Fish", if a card is transferred following a request, the recipient player likewise is benefited by potentially having generated a pair or four-of-a-kind which the player may then discard prior to the close of his or her turn. According to at least one customary method of play, that player is allowed to take another free turn.

Not present in either of the two games described, or apparent in the prior art, generally, is a feature whereby players are required to exchange cards at the close of their turn without any option thereafter during that turn to change the composition of their hand. As described more in detail below, this feature has the potential for building suspense for the players in a way that is not described in the prior art.

Thematic considerations in games

The card games just described, as well as other amusements, can be adapted to various themes to enhance their marketability. Producers of games and toys often tailor their products to take advantage of current commercial trends and contemporary consumer interests or fads. For example, often, in association with the release of a new motion picture, toy manufacturers sell merchandise bearing features taken directly from the motion picture. Accordingly, toys ranging from action figures and dolls to games and youth literature are frequently marketed so as to take advantage of trends in popular culture. Likewise, toys, games and books have been manufactured and sold which reflect less transient elements of culture. Characters and themes from classic books and nursery rhymes, for example, appear and reappear in the play things enjoyed by each new generation. Producers of toys and games stand to benefit by designing into their products a certain degree of flexibility accommodating adaptation to themes of cultural interest. Individuals, as well, enjoy and appreciate opportunities to exercise flexibility and adaptation in their endeavors. Crafts, for example, offer one avenue for expressing personal creativity, and they may be adapted to the personal interests of those who enjoy them.

Although adaptability and flexibility are qualities appreciated by consumers of certain goods, those features are by no means apparent across the gamut of products sold by the toy and game industry. Many prior art card games lack a significant degree of flexibility either for game manufacturers to customize games according to themes, or to empower players, themselves, to fashion game pieces and equipment.

SUMMARY OF THE INVENTION

The present invention provides a game that can be played using cards (or other similar elements as explained in detail below). According to the game, multiple players engage in play generally involving steps comprising: 1)individual players, in turn, taking actions based on directions associated with the cards held in their hands at the beginning of their turn, and then 2) transferring cards by drawing cards from other players' hands. The actions taken by a player executing his or her turn may have favorable or unfavorable consequences to that player's and others' competitive interests in the game.

Turns continue through the progression of the game until its conclusion with players taking turns according to a rotational sequence. For purposes of this disclosure, including the claims; "rotational sequence" refers to a sequence of play in which players engage in turns serially until each has had a turn, whereupon the first to play then takes another turn, and play progresses in the new round according to the order established in the earlier round.

Suspense and diversion in the game derive, in part, from those favorable or unfavorable consequences, as well as from the "drawing" step occurring at the end of a player's turn. Because of this unique feature, players may lose desirable cards or acquire undesirable ones without possibility for immediate recourse to either capitalize on or minimize the effect of those consequences:

The invention, generally, including the embodiments disclosed herein, is flexible and adaptable to various themes. For example, various of the elements of the game may be associated for purposes of presentation and marketing with story characters of contemporary or enduring interest to children and families. The degree of flexibility and adaptability of the game even conveniently affords the option of empowering purchasers of the game and their families to individually customize game pieces according to their own desires. Finally, the invention can be adapted without departing from the spirit of this disclosure and the appended claims to various electronic, computer-implemented or other embodiments of interest to or demanded by consumers.

An object of the invention is to provide a game utilizing cards and tokens for play by a plurality of players.

Another object of the invention is to provide a game, comprising a set of rules of play including a provision requiring players to take turns in rotational sequence, wherein a turn comprises the player engaging in the turn taking at least one specific action with respect to at least one card held by that player at the outset of the turn, and the player engaging in the turn acquiring at least one card not held by that player at the outset of the turn.

Another object of the invention is to provide a game including a provision in the rules prohibiting players from taking action in the course of a turn with respect to any cards acquired by them during such turn.

Another object of the invention is to provide a game that includes a provision for players exchanging cards at the end of a turn.

Another object of the invention is to provide a game that is suited to adaptation to desired themes and even customization of cards and tokens by the user.

These and other objects, novel features and advantages of the present invention will become apparent to those skilled in the art upon examination of the following description, including the drawings or may be learned by practice of the invention. The objects and advantages of the invention may be realized and attained by means of the instrumentalities and combinations particularly pointed out in the appended claims.

DETAILED DESCRIPTION OF THE INVENTION

For purposes of the disclosure, including the appended claims, the game to be described may be played using traditional tangible playing cards (such as are commonly made of paper, cardboard or plastic) adapted to include the various indicia consistent with aspects of the invention described in this disclosure and necessary to achieve the ends of the game. It is, however recognize that the principles of the game may be equally suited to play using other elements substituted for traditional playing cards. Such other items could include, for example, items similar to dominoes, other tangible game pieces, or even electronic or computer-generated representations of elements having characteristics similar to playing cards, so long as the necessary indicia, or their equivalents, can be included on those items. Therefore, when commonly-understood game terms (such as "card", "cards", "deck", "hand", "play", "draw" and "discard") are used in this disclosure, including the claims, they are intended both to apply in the context of traditional playing cards according to the game terms' usual meanings, and also to apply analogously where other tangible or electronic substitutes for traditional playing cards are used.

Additionally, for purposes of this disclosure, it is acknowledged that game objects may be characterized equivalently in either positive or negative terms without substantially departing from fundamental principles of play. Specifically, it is considered to be a matter of choice whether a game object is defined, for example, as gaining a maximum number of points compared with competitors (where points are deemed to be favorable) or as collecting the fewest number of points compared to competitors (where points are deemed to be a liability). Accordingly, in all instances in this disclosure where objectives are recited in a positive form of characterization, and an equivalent negative form of characterization could logically be inferred, such recitation is intended to mean and include both the positive the corollary negative forms of characterization.

Fundamentally, the claimed invention is a game wherein a plurality of players compete for either points or physical representations connoting points, (both herein referred to as tokens). The object of the game is to acquire and possess as many tokens as possible when play is complete. The winner is that player (or those players in the case of a tie) with the most tokens at the end of the game.

Play of the game takes place using cards bearing indicia that direct players to take various actions including acquiring and losing tokens, protecting tokens against loss, and changing the composition of one's hand by either drawing cards or discarding cards, or both. As will be explained, drawing of cards may be from a deck or from opponents' hands. Play of the game also requires using tokens (as defined in this disclosure) which ultimately determine who wins the game.

Specific cards are identified according to their indicia which, as in the case of many well-known card games, are known only to players holding them (until such time as those players reveal the cards to other players). Necessary types of cards include the following:

A first card (herein designated a protagonist card) that permits a player who holds and turns in such a card at a designated time to acquire, for example, one token. (According to one embodiment of the invention, protagonist cards make up a proportion of about ¼ to ⅙ of the cards in the deck.)

A second card (herein designated a antagonist card) that requires a player who holds such a card at a designated time to turn in the card and lose, for example, one token. (According to one embodiment of the invention, antagonist cards make up a proportion of about ¼ to ⅙ of the cards in the deck.) Optional other types of cards (used according to an embodiment of the invention) include:

A third card (herein designated a protection card) that permits a player who holds such a card at a designated time to associate such a card with, for example, one token and thereby render that token invulnerable to loss by that player due to action of a antagonist card. (According to one embodiment of the invention, protection cards make up a proportion of about 1/5 to 1/10 of the cards in the deck.)

A fourth card (herein designated a wild card) that premits the player holding that card at a designated time to, for example, trade in that card for another card drawn from a deck of cards. Optionally, rather than turning in the wild card as just described, a player may electy to retain it in his or her hand in hopes of collecting, over ther course of play, more than one (for example, three) wild cards. Cards retained in this fashion may, for example, according to this option, be turned in at a designated time to acquire, for instance, one token. (Another optional variation of the use of wild cards is to allow players who turn in multiple wild cards to acquire more than one toaken (for example, two or three tokens), thereby enchancing the benefit of holding such cards.) (According to one embodiment of the invention, wild cards make up a proportion of about 1/4 to 1/6 of the cards in the deck.)

Other cards may be included, as well. Such other cards are herein designated match cards and may comprise various categories or types of cards defined by indicia on the cards. According to one embodiment of the invention, match cards offer an opportunity for players, holding pairs of such cards at a designated time, to discard such pairs. As will be explained further below, discarding under certain circumstances, may lead to potentially desirable changes in the composition of players' hands. (According to one embodiment of the invention, match cards make up the balance of cards in the deck following inclusion of the other cards just described in the proportions noted.)

The numbers and proportions of the various types of cards in a deck may be adjusted and is considered to be a matter within the scope of reasonable experimentation by those skilled in the art of game manufacture and marketing. The precise numbers and proportions for specific applications will depend on the desired complication and pace of each particular game being devised or constructed according to the principles of the invention. Additionally, the number of players and certain operational rules associated with particular game applications are considered to be flexible and within the expertise of game manufacturers and marketers. Such operational rules may include such considerations as sequence of play and game completion.

The game just described offers a general structure and specific play elements that are well suited to adaptation to various themes. For example, the protagonist and antagonist cards described may be devised to bear correlation to characters in stories. The matching cards and other elements such as the wild cards could be associated with, for example, minor characters or other memorable parts of stories. As indicated above, both contemporary or traditional themes may be employed to enhance the market appeal or uniqueness of embodiments of the game. It is envisioned that, without departing from the inventive game principles explained herein, a manufacturer of games and amusements could market an array of products, for example, tying in with a popular series of books or motion pictures, or alternatively, with historical or mythical characters. In this way, the game is easily adapted for educational purposes.

Another feature of the game, and an extension of the adaptability of the invention, just discussed, is that it is suited to personal customization by individuals and families, thereby adding to the fun and uniqueness of the game. For example, game elements such as cards can be provided without elaborate designs or colors, or even with very limited indicia adequate simply to permit distinguishing one card from another. This offers the users the opportunity to design and decorate the cards according to their own interests and preferences. One approach to marketing such a product could include providing decoration suggestions and even art supplies suited to coloring and customizing the appearance of the cards and tokens.

EXAMPLES

Two examples follow, the first describing play for between three and six players, and the second describing a modification of play for two players. These examples describe functional invention embodiments and include specific numbers of cards and types of cards considered by the inventors to be optimal for the complication and pace of the game they prefer.

Example 1

As noted, this example describes the preferred embodiment of the invention for play of the game by players numbering from three to six. According to this embodiment, a deck of eighty-four cards used. The cards in the deck comprise the following:

12 protection cards 18 first category match cards 9 second category match cards 15 protagonist cards 12 wild cards 18 antagonist cards Additionally, twenty-six tokens are used.

Prior to the beginning of play, each player is supplied with five tokens. The dealer shuffles the deck and deals four cards to each player. The remainder of the deck is then set aside to serve as a drawing pile (deck). The player to the Dealer's left takes the first turn. The other players then take turns following in a clockwise sequence. Each turn comprises two parts: First, the player initiating the turn takes actions dictated by the cards the player holds in his or her hand. Also included in this part of the turn is the possibility that the player will draw four new cards from the deck in the event that the player discards or otherwise plays all of the cards held in his or her hand. Second, the player concludes the turn by drawing a card from an opponent.

The first part of a turn

According to this embodiment, actions taking place in the first part of the turn include:

Turning in (discarding) any antagonist cards and giving up one token for each antagonist card turned in. (Turning in antagonist cards is not optional, according to this embodiment. The rules according to this embodiment require turning in such cards, and giving up a token so long as the player possesses any unprotected tokens. The only time a player may hold antagonist cards in his or her hand is when that player does not have any unprotected tokens.)

Turning in (discarding) any protagonist cards and acquiring one new token for each protagonist card turned in. (Turning in protagonist cards, likewise, is not optional. The rules according to this embodiment require turning in and collecting tokens for all such cards held by a player at the beginning of his or her turn.)

According to this embodiment, turning in antagonist cards and protagonist cards is considered a priority. Therefore, all such cards held at the beginning of a player's turn must be turned in, and associated actions taken, before any other actions are taken by the player in the course of his or her turn. After antagonist cards and protagonist cards have been played in the fashion just described, the player exercising his or her turn may take the following actions (in any order).

Optionally turning in (discarding) wild cards and exchanging each for a new card drawn from the deck. (As mentioned, however, players may choose to hold their wild cards in hopes of collecting a set of such cards (three, according to this example embodiment) which, if held until the beginning of their next turn, can be turned in (discarded) in exchange for one token.)

Using (playing) protection cards to protect unprotected tokens. According to this embodiment, protection of a token is signified by placing the token on top of the protection card.

Optionally, turning in (discarding) any matching pairs of match cards. Again, according to the invention, such actions may be taken only with regard to cards that were held by the player at the outset of his or her turn. Cards acquired as a result of drawing from the deck (as set forth below) or from other players (at the end of the individual's turn) must not be played immediately, but rather held. In this way, those newly acquired cards are made available for possible selection by other players in subsequent turns or perhaps retained until that individual's own next turn.

The second part of a turn

In the second part of the turn, drawing from an opponent, takes place. The drawing step signifies the close of a player's turn. The player is not entitled to take action with respect to any card so drawn until the beginning of that player's next turn in the sequence of play. It is possible, therefore, that the player will not experience a chance to use the drawn card (even if it is favorable to the player) since that card might be selected by an opponent and drawn out of the player's hand during a subsequent turn by another player.

Consequences and other features of the sequence of play

As play proceeds, the players may accumulate or lose tokens, they may protect tokens against loss, and they may acquire different cards. The composition of their hands will change as a result of the drawing, playing or discarding of cards (including turning in pairs of match cards). In this embodiment, at any time the number of cards in a player's hand drops to zero, he or she is required to immediately draw four new cards.

Play continues, according to this embodiment, with players taking turns a clockwise fashion until all of the cards in the deck have been drawn. In this example, play ends immediately upon the last card in the deck being drawn. The game is over when there are no more cards left in the drawing pile, even if the players continue to hold cards in their hands that they would like to play. According to this embodiment, the winner is the player holding the most tolkens at the end of the game. A tie is declared if more than one player shares the record for the most tokens.

Although this example describes play by a group of from three to six players, it is anticipated that a larger number of players could successfully play the game following similar rules.

Example 2

This example describes a modification of the embodiment just described in Example 1 for play involving only two players.

Fundamentally, the principles of the game are the same when two players play instead of three or more players. A similar deck of cards may be used, without alteration. There is a possibility however, that since players only have a single opponent with whom to exchange cards, play can stagnate, with players repeatedly trading the same cards with neither acquiring a hand composition that will permit discarding or other play of cards. Instances of such a situation would include a case in which the two opposing players exchange match cards without being able to compile a matching pair, or when the players each have all of their tokens protected, but continue to exchange antagonist cards. Therefore, in this example embodiment, after a fixed number of turns (for example, three), if no cards are played, discarded or drawn from the deck, the players are required to simply discard all of the remaining cards in their hands, each draw four new cards, and resume play.

It is noted that the modification just described may also be employed where more than two players are engaged in play. It is possible (although instances will be rare) that, even with more than two players, play will progress to a condition in which the players repeatedly exchange cards without being able to take any of the actions that will result in a change in the mix of cards. Requiring the players (after, for example, three rounds of turns without activity) to turn in all of their cards and each draw four new cards will fairly restore vitality to the flow of play.

It is noted that various modifications of the game can be made without departing from the spirit and scope of the appended claims. Such modifications may include such things as provision for breaking a tie at the end of a game as well as specific operational rules designed to facilitate play under given circumstances. Modifications such as these are considered to be within the scope of the invention.

The examples discussed above are cited merely to illustrate particular embodiments of the invention. It is intended that the scope of the invention be defined by the claims appended hereto.

We claim:

1. A method of playing a game utilizing cards and tokens for play by a plurality of players according to a set of rules, the method comprising the steps of:

(a) requiring players to take turns in rotational sequence, wherein a turn comprises (1) a player engaging in the turn by taking at least one card-specific action with respect to at least one card held by that player at the outset of the turn, the at least one card-specific action being selected from the group consisting of (i) in accordance with the set of rules, surrendering such at least one card so as to affect a change such player's circumstances in relation to other players in the game, (ii) in accordance with the set of rules, utilizing such at least one card, without surrendering it, so as to affect a change in such player's circumstances in relation to other players in the game, and (iii) in accordance with the set of rules, holding the at least one card without other action, and (2) the player engaging in the turn acquiring at least one card not held by that player at the outset of the turn, wherein this step includes taking such at least one card from an opposing player, and (b) prohibiting players from taking card-specific action, other than holding, in the course of a turn with respect to any cards acquired by them during such turn.

2. The method of claim 1 wherein the taking of at least one card from an opposing player occurs as the last action taken by the player engaging in the turn before concluding the turn.

3. The method of claim 2 further comprising a provision in the set of rules whereby if a player runs out of cards that player immediately draws new cards from a source of cards containing a finite number of cards.

4. The method of claim 3 further comprising a provision in the set of rules whereby if players engage in a given number of turns without taking action other than holding cards and taking cards from opposing players, after the conclusion of the given number of such turns, the players each exchange all of their cards for new cards from the source of cards.

5. The method of claim 4 wherein the given number of turns after which the players exchange all of their cards for new cards is three.

6. The method of claim 4 wherein players acquire at least one token in exchange for turning in a first species of card.

7. The method of claim 6 wherein players forfeit at least one token in exchange for turning in a second species of card.

8. The method of claim 7 wherein players avoid forfeiture of tokens by associating a third species of card with tokens, thereby protecting them from such forfeiture.

9. The method of claim 8 wherein winners are determined according to the number of tokens the players possess when the source of cards is entirely depleted as a result of players drawing new cards from it.

10. The method of claim 9 wherein the cards and tokens are capable of customization by users.

11. The method of claim 10 wherein said customization is selected from the group consisting of:

decorating said tokens, modifying characteristics said tokens other than through decoration, decorating said cards, modifying said cards other than through decoration, and any combination of the foregoing.

12. The method of claim 11 wherein the first species of card, the second species of card and the third species of card bear indicia corresponding aspects of at least one theme selected from the group consisting of a theme associated with a popular story, a theme associated with a classic story, a theme associated with a motion picture, and a theme of popular interest but not associated with a particular story or motion picture.

13. The method of claim 9 wherein the tokens, the first species of card, the second species of card and the third species of card bear indicia corresponding aspects of at least one theme.

14. The method of claim 13 wherein the at least one theme is selected from the group consisting of a theme associated with a popular story, a theme associated with a classic story, and a theme associated with a motion picture.

15. The method of claim 14 wherein at least one species of card bears indicia that corresponds to a protagonist character and at least one different species of card corresponds to an antagonist character.

16. A method of playing a card game including play by a plurality of players taking turns in rotational sequence comprising the steps of:

requiring a player executing a turn, prior to the end of that turn, to acquire at least one card not held by that player at the outset of the turn, and acquisition of the at least one card not held by the player at the outset of the turn is the final event of play by said player prior to ending the turn, and prohibiting such player, during the course of the turn, from taking, with respect to the at least one card acquired, any action other than holding such acquired at least one card.

17. The method of claim 16 wherein the at least one card not held by the player at the outset of the turn is acquired as a result of the player drawing the at least one card from another player.

* * * * *